US011788362B2

(12) United States Patent
Clark et al.

(10) Patent No.: US 11,788,362 B2
(45) Date of Patent: Oct. 17, 2023

(54) PISTON-BASED BACKUP ASSEMBLY FOR DRILL BIT

(71) Applicant: Halliburton Energy Services, Inc., Houston, TX (US)

(72) Inventors: Kevin Clark, Willis, TX (US); Kelley Plunkett, The Woodlands, TX (US); Andrew D. Lake, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 57 days.

(21) Appl. No.: 17/551,310

(22) Filed: Dec. 15, 2021

(65) Prior Publication Data

US 2023/0184042 A1 Jun. 15, 2023

(51) Int. Cl.
*E21B 10/633* (2006.01)
*E21B 12/04* (2006.01)

(52) U.S. Cl.
CPC ..... *E21B 12/04* (2013.01); *E21B 10/633* (2013.01)

(58) Field of Classification Search
CPC ..... E21B 12/04; E21B 10/633
See application file for complete search history.

(56) References Cited

U.S. PATENT DOCUMENTS

| | | | |
|---|---|---|---|
| 5,099,934 | A | 3/1992 | Barr |
| 6,142,250 | A | 11/2000 | Griffin et al. |
| 7,836,975 | B2 | 11/2010 | Chen et al. |
| 7,849,939 | B2 | 12/2010 | Downton et al. |
| 7,971,662 | B2 | 7/2011 | Beuershausen |
| 8,061,455 | B2 | 11/2011 | Beuershausen |
| 8,087,479 | B2 | 1/2012 | Kulkarni et al. |
| 8,141,657 | B2 | 3/2012 | Hutton |
| 8,205,686 | B2 | 6/2012 | Beuershausen |
| 8,240,399 | B2 | 8/2012 | Kulkarni et al. |
| 9,080,399 | B2 | 7/2015 | Oesterberg |
| 9,267,329 | B2 | 2/2016 | Bilen |
| 9,976,353 | B2 | 5/2018 | Hinz et al. |
| 10,000,977 | B2 | 6/2018 | Jain et al. |
| 10,066,439 | B2 | 9/2018 | Hinz et al. |
| 10,273,759 | B2 | 4/2019 | Ricks et al. |
| 10,323,465 | B2 | 6/2019 | Chen et al. |

(Continued)

FOREIGN PATENT DOCUMENTS

| | | |
|---|---|---|
| CN | 107208476 | 9/2017 |
| EP | 2401467 | 1/2012 |

(Continued)

*Primary Examiner* — Taras P Bemko
(74) *Attorney, Agent, or Firm* — Michael Jenney; C. Tumey Law Group PLLC

(57) ABSTRACT

A drill bit and method incorporate backup assemblies that limit depth of engagement of cutters with the formation. The backup assemblies dynamically adjust exposure relative to a cutting profile in response to downhole loading conditions. In an example, cutters are secured to the cone, nose, shoulder, and/or gage regions of the bit body. One or more backup assemblies are provided on the cone, nose, or shoulder region, and optionally, on the gauge region. A backup element on an outwardly facing end of the piston limits a depth of cut of one or more of the cutters. The backup element may be rigidly secured or rotatably secured to the piston. The piston may be biased outwardly to a neutral position aligned with or overexposed relative to the cutting profile.

15 Claims, 6 Drawing Sheets

(56) References Cited

U.S. PATENT DOCUMENTS

| | | | | |
|---|---|---|---|---|
| 10,358,873 | B2 | 7/2019 | Do et al. | |
| 10,494,876 | B2 * | 12/2019 | Mayer | E21B 10/62 |
| 10,501,999 | B2 | 12/2019 | Grosz et al. | |
| 10,745,973 | B2 | 8/2020 | Grosz et al. | |
| 10,801,269 | B1 | 10/2020 | Hankins et al. | |
| 10,975,627 | B2 | 4/2021 | Ling et al. | |
| 2009/0065262 | A1 | 3/2009 | Downton et al. | |
| 2010/0071956 | A1 | 3/2010 | Beuershausen | |
| 2010/0212964 | A1 | 8/2010 | Beuershausen | |
| 2011/0031025 | A1 | 2/2011 | Kulkarni et al. | |
| 2011/0147089 | A1 | 6/2011 | Kulkarni et al. | |
| 2012/0255788 | A1 | 10/2012 | Schwefe et al. | |
| 2014/0174827 | A1 | 6/2014 | Schen et al. | |
| 2014/0262511 | A1 | 9/2014 | Bilen | |
| 2015/0152723 | A1 | 6/2015 | Hay | |
| 2015/0191979 | A1 | 7/2015 | Jain et al. | |
| 2016/0237755 | A1 * | 8/2016 | Cox | E21B 10/56 |
| 2017/0159370 | A1 | 6/2017 | Evans et al. | |
| 2017/0175454 | A1 * | 6/2017 | Ricks | E21B 10/42 |
| 2017/0204673 | A1 * | 7/2017 | Shi | E21B 10/46 |
| 2017/0362898 | A1 * | 12/2017 | Do | E21B 10/42 |
| 2018/0030786 | A1 * | 2/2018 | Dunbar | E21B 10/42 |
| 2019/0063162 | A1 * | 2/2019 | Bomidi | E21B 10/43 |
| 2021/0340823 | A1 * | 11/2021 | Lake | E21B 12/00 |

FOREIGN PATENT DOCUMENTS

| | | |
|---|---|---|
| EP | 2859172 | 1/2016 |
| WO | 2013188206 | 12/2013 |
| WO | 2014165120 | 10/2014 |
| WO | 2016043755 | 3/2016 |
| WO | 2018231240 | 12/2018 |

* cited by examiner

PISTON-BASED BACKUP ASSEMBLY FOR DRILL BIT

BACKGROUND

During drilling, cutters may be damaged due to impact loads and vibration, particularly from certain drilling anomalies. For example, "bit whirl" is an undesirable drilling phenomenon wherein the bit may intermittently get stuck causing torsion builds in the drill string. When the torsion overcomes friction between the drill bit and the formation, the energy stored in the drill string is released, causing the bit to move in a reverse direction. This reverse motion can sometimes chip or even break a diamond table from a cutter. Also, axial vibrations can be detrimental to bit performance by causing oscillations in the drilling torque. Axial vibrations dramatically increase the wear rate of PDC cutters and can lead to catastrophic damage to the cutting structure.

Various non-cutting elements are sometimes affixed to a drill bit to limit depth of cut, which may provide some protection to the cutters against breakage due to vibration and instability. Such non-cutting elements are typically at a fixed position. These non-cutting elements are also typically underexposed, i.e., set below the cutting profile defined by cutters to engage the formation being drilled after the primary cutters have abraded some amount or been damaged.

BRIEF DESCRIPTION OF THE DRAWINGS

These drawings illustrate certain aspects of some of the embodiments of the present disclosure and should not be used to limit or define the method.

DETAILED DESCRIPTION

Figure 1:
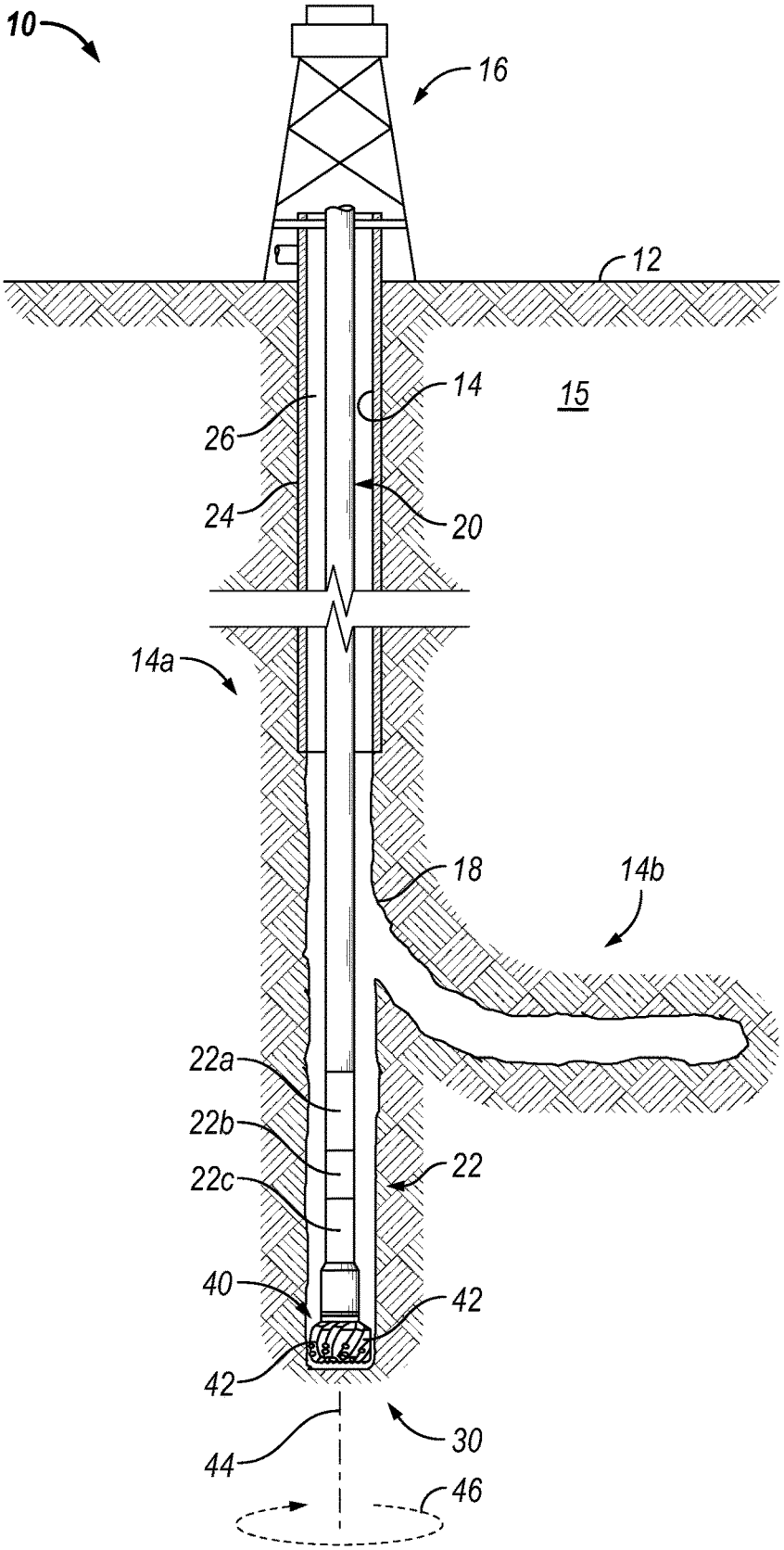
FIG. 1 is an elevation view of a drilling system in which a drill bit according to aspects of this disclosure may be used to drill a wellbore.

A drill bit and method are disclosed that use backup assemblies to limit depth of engagement of cutters with the formation. The backup assemblies dynamically adjust exposure in response to downhole loading. The backup assemblies are strategically located at different regions of the bit body. Each backup assembly comprises a backup element secured to an outwardly-biased piston. The backup element is a component or portion positioned to engage the formation while drilling, other than a primary cutter. The backup element can function as a depth of cut control (DOCC) element to limit a depth of cut of a primary cutter. The DOCC element in some embodiments comprises a wear element rigidly secured to the piston (non-rolling). A backup element may be considered passive if it has a substantially non-cutting shape, such as a domed element that slides along the formation. Alternatively, a backup element may be considered active if it is shaped to disintegrate formation material, such as a pointed cutter for pre-fracturing rock (formation material) behind a primary cutter, or a fixed, backup cutter for actively cutting formation behind a primary cutter. In other embodiments, the DOCC element comprises a rolling element rotatably secured to the piston and may roll along the formation while drilling. The piston is moveably coupled to the bit body and is biased outwardly. The backup assemblies thereby adapt to engagement forces while drilling by moving inwardly to change their exposure in relation to an engagement force with the formation.

This biasing and variable engagement may be tailored to a specific drill bit design and/or drilling application to optimize ROP with varying engagement. This helps reduce the likelihood of having too little underexposure that engages too much and overly limits ROP or having too-much underexposure and is ineffective at limiting ROP where needed.

In some embodiments, the backup assemblies may be biased to neutral positions aligned with or over-exposed relative to a cutter profile defined by one or more nearby cutters. This enables the backup elements to initially engage the formation before or at about the same time as the respective primary cutting elements, to provide more protection to the cutters against damage. The backup elements on the backup assemblies may thereby remain in contact with formation. The ability to remain in contact with the formation and dynamically adjust exposure improves the backup element's ability to absorb impact loadings that would otherwise have to be absorbed by the cutters. The continued engagement with formation may also improve the stability of the drill bit by counteracting vibrations.

The backup assemblies may be located anywhere on the drill bit, particularly on the nose, cone, and/or shoulder regions, which are forward/inward of a gauge region. Backup assemblies on the nose region can limit lateral vibrations during all modes of drilling and thus reduce the chances of bit whirl. Backup assemblies on the nose region and cone region may help counteract axial vibrations that can cause oscillations in the drilling torque. Backup assemblies on the shoulder and gauge regions may help to dampen lateral vibrations, stabilizing the bit to limit the destructive effects of bit whirl. Backup assemblies may also be included on the gauge region if desired, for other functional reasons such as to protect the gauge region of the bit.

A drill bit incorporating aspects of this disclosure may adapt aggressiveness and overall bit response based on different loading conditions. For example, as weight on bit (WOB) increases, resulting in greater axial loading at the bit, the backup assemblies nearer the leading end of the bit (e.g., on the cone or nose) may be urged inwardly to provide an increased depth of cut and rate of penetration (ROP). In a curved or lateral borehole, lateral force components on the drill bit may urge other backup assemblies, particularly those on the shoulder region, to move inwardly and reduce their exposure relative to the cutting profile.

As a drill bit transitions from a less aggressive drilling mode (e.g., requiring steerability) to a more aggressive drilling mode where a maximum ROP is desired, the moveable backup assemblies may adapt to the aggressiveness. For backup assemblies on the nose, cone, and upper shoulder regions, the element is pushed inward, reducing exposure in response to increased weight on bit (WOB) and the reaction force with the formation. The borehole size is typically slimmer in curved sections (requiring more steering) and wider in horizontal sections (requiring higher ROP), and thus backup assemblies on the gauge and lower shoulder regions change exposure in response to the reduced clearance between the gauge pad and the sidewall of the bore.

FIG. 1 is an elevation view of an example drilling system 10 in which a drill bit 40 according to aspects of this disclosure may be used to drill a wellbore 14. Drilling system 10 may be assembled at a well site with drilling equipment such as a rotary table, drilling fluid pumps and drilling fluid tanks at an above ground location (i.e., at the surface) 12. For example, a drilling rig 16 may be provided with various features associated with terrestrial drilling operations with a land drilling rig. However, teachings of the present disclosure may be applied in offshore drilling operations, e.g., operations with drilling equipment located on offshore platforms, drill ships, semi-submersibles and drilling barges. The drilling system 10 includes a drill string 20 including a bottom hole assembly (BHA) 22 with the drill bit 40 secured at a lower end for forming a wellbore 14 in an earthen formation 15 below the surface 12. The wellbore 14 may follow any given wellbore path to reach one or more target zones in the formation 15. The wellbore 14 in this example happens to be a multilateral wellbore that includes a generally vertical main bore 14*a* and at least one wellbore branch 14*b* that deviates from vertical. The wellbore branch 14*b* may be formed, for example, using a whipstock assembly at a multilateral junction 18. Various directional drilling techniques may also be used to control the direction of drilling of the wellbore(s) in an effort to reach one or more target zones.

The BHA 22 may include the drill bit 40 and any number of other BHA components, schematically depicted at 22*a*, 22*b* and 22*c*, coupled to the drill string 20 above the drill bit 40. The BHA components 22*a*, 22*b* and 22*c* may include, but are not limited to, drill collars, rotary steering tools, directional drilling tools, downhole drilling motors, reamers, hole enlargers, stabilizers etc. The number and types of BHA components 22*a*, 22*b* and 22*c* may depend on anticipated downhole drilling conditions and the type of wellbore 14 that will be formed by drill string 20 and rotary drill bit 40. The BHA 22 may also include various types of well logging tools (not expressly shown) and other downhole tools associated with directional drilling of a wellbore. Examples of logging tools and/or directional drilling tools may include, but are not limited to, acoustic, neutron, gamma ray, density, photoelectric, nuclear magnetic resonance, rotary steering tools and/or any other commercially available well tool. The BHA components 22*a*, 22*b* and 22*c* may also include a downhole motor capable of rotating the drill bit 40 with respect to an upper portion of the drill string 20. The wellbore 14 may be drilled by engaging the drill bit 40 with the formation while rotating the drill bit 40, such as by rotating the entire drill string 20 from the surface and/or by rotating the drill bit 40 with the mud motor.

The wellbore 14 may be defined in part by a casing string 24 that may be cemented in place, extending along at least a portion of the wellbore 14. Portions of the wellbore 14 that do not include casing string 24 may be described as "open hole." Various types of drilling fluid, or "mud," may be pumped from the surface 12 through drill string 20. The drilling fluid may be expelled from the drill string 20 through nozzles passing through the drill bit 40. The drilling fluid may be circulated back to surface 12 through an annulus 26 defined between an outside diameter of the drill string 20 and a surrounding structure. Along an open hole portion, the annulus 26 is defined between the drill string 20 and an inside diameter of the wellbore 14*a*. The inside diameter may be referred to as the sidewall of the wellbore 14*a*. Along a cased portion, the annulus 26 may be defined between the drill string 20 and an inside diameter of the casing string 24.

The drill bit 40 may rotate with respect to a bit rotational axis 44 in a direction defined by directional arrow 46. As the drill bit 40 is rotated, the cutters, which may include fixed cutters and/or rolling cutters, may engage and cut the formation. As discussed below, a plurality of DOCC elements may be provided on the drill bit 40 to limit the engagement of the cutters. The cutters may cut by scraping, gouging, shearing, or otherwise disintegrating the formations surrounding wellbores 14. The resulting cuttings may be continuously removed by the drilling fluid circulated through the drill string 20 back to the surface 12, where the cuttings may be removed from the drilling fluid by surface equipment.

Figure 2:
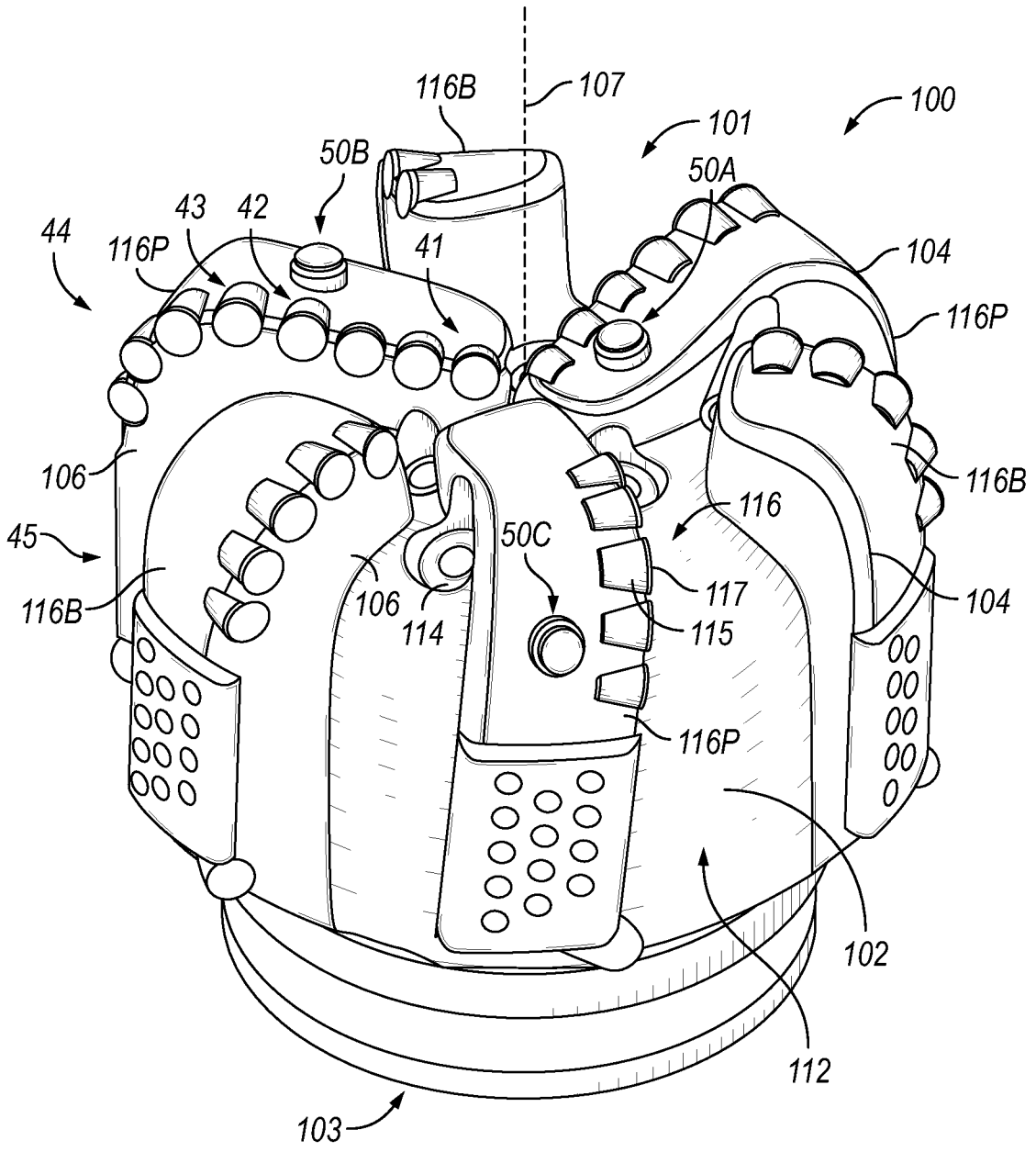
FIG. 2 is an isometric view of an example configuration of the drill bit.

FIG. 2 is an isometric view of a drill bit 100 in accordance with aspects of the present disclosure, as an example configuration of the drill bit 40 generally depicted in FIG. 1. For ease of discussion, the drill bit 100 is oriented with a leading end 101 pointed axially upwardly in FIG. 2 to illustrate various features discussed below, but the leading end 101 would be oriented in the direction of drilling (e.g., downwardly or at a deviated drilling angle). The drill bit 100 includes a bit body 102, which may be formed, for example, from a steel or a metal matrix composite. The bit body 102 includes six radially and longitudinally extending blades 104, although other bit bodies may include a different number of blades. More specifically, the blades 116 in this example may include three primary blades 116P and three backup blades 116B. Junk slots 112 are defined between adjacent blades 104. A plurality of nozzles or ports 114 can be arranged within junk slots 112 for ejecting drilling fluid that cools the drill bit 100 and otherwise flushes away cuttings and debris generated while drilling. When incorporated into a drill string (e.g., FIG. 1), the bit body 102 generally rotates about a longitudinal drill bit axis 107 with leading faces 106 of the blades 104 facing the direction of rotation.

The bit body 102 may be organized into regions or sections, generally indicated as a cone region 41, nose region 42, a shoulder region sub-divided organizationally into an upper shoulder 43 and lower shoulder 44, and a gauge region 45. The cone region 41 is nearest the bit axis toward a leading end of the drill bit 100. The nose region 42 is radially outward of the cone region 41, and slightly axially forward of the cone region 41, at least in this example. The upper shoulder 43 is radially outward of the nose region 42. The lower shoulder 44 is radially outward of, and axially trailing, the upper shoulder 43. The gauge region 45 is proximate an outer diameter of the drill bit 100. Cutters 116 may be secured to the bit body in each of the different regions 41-45. Some embodiments may include primary cutters and backup cutters, wherein the primary cutters may be in a first row of cutters on a blade and the secondary cutters are behind the primary cutters. Note that the terms "primary" and "secondary" is not intended to imply an association between primary cutters and primary blades or between secondary cutters and secondary blades. For example, some embodiments may include a row of backup cutters behind a row of primary cutters on the same blade.

The drill bit 100 may be categorized as a fixed cutter drill bit, in that its cutting structure comprises a plurality of cutters 116 secured at fixed cutting orientations to drill into the earthen formation under an applied weight-on-bit (WOB). The plurality of fixed cutters 116 may be secured to the blades 104 within corresponding cutter pockets sized and shaped to receive the fixed cutters 116. Each cutter 116, in this example, comprises a fixed cutter secured within its corresponding cutter pocket via brazing, threading, shrink-fitting, press-fitting, snap rings, or any combination thereof. The fixed cutting orientation at which the fixed cutters 116 are held in blades 104 and respective cutter pockets may comprise predetermined angular orientations and radial locations and may present the fixed cutters 116 with a desired back rake angle against the formation being drilled.

Each fixed cutter 116 may include a generally cylindrical substrate 115 made of a hard material, such as tungsten carbide (WC), and a cutting element 117 secured to the substrate 115. The working surface of the cutting element is typically flat or planar but may also exhibit a curved or otherwise non-planar exposed surface that defines a cutting edge oriented for cutting into an earthen formation. The cutting element 117 may include one or more layers of an ultra-hard material, such as polycrystalline diamond (PCD), polycrystalline cubic boron nitride, impregnated diamond, etc., which generally forms a cutting edge and the working surface for each fixed cutter 116. In some cases, a PCD cutting element may be formed and bonded together with the substrate 115 in a high-temperature, high-pressure press cycle, with the resulting cutter referred to as a polycrystalline diamond compact (PDC). When using polycrystalline diamond as the ultra-hard material, fixed cutter 116 may be referred to as a polycrystalline diamond compact cutter or PDC cutter, and drill bits made using such PDC fixed cutters 116 are generally known as PDC bits.

During drilling, the fixed cutters 116 are driven through the earthen formation ("rock") by the combined forces of the weight-on-bit and the torque applied to the drill bit 100. During drilling, the fixed cutters 116 may experience a variety of forces, such as drag forces, axial forces, reactive moment forces, or the like, due to the interaction with the underlying formation being drilled as drill bit 100 rotates. Cutters 116 in the cone region 41 and nose region 42 generally support a substantial amount of the axial loading on the bit 100 when drilling. Cutters 116 more radially outward, such as on the upper/lower shoulder 43, 44 and gauge 45 support a larger proportion of lateral loading, particularly when drilling a curved section (e.g., lateral or deviated wellbore).

The drill bit 100 also has backup assemblies 50 positioned at various locations along the drill bit 100. The backup assemblies 50 may be positioned, for example, behind cutters 116, such as behind a primary row of cutters, on one or more of the blades 104. The backup assemblies 50 include backup elements (e.g., wear elements and/or rolling elements) that engage the formation and support some of the drill bit loading while drilling. By way of example, in FIG. 2, three backup assemblies are shown including a first backup assembly 50A in the cone region 41 of one of the blades 104, a second backup assembly 50B in the nose region 42 of another one of the blades 104, and a third backup assembly 50C in the upper shoulder region 43 of one of the blades 104. Additional backup assemblies (not shown) may be supported on other blades 104 and in other regions of any of the blades 104, such as in the lower shoulder 44 and gauge region 45.

One or more of the backup assemblies 50 have a default exposure corresponding to a neutral position relative to the cutting profiles of adjacent cutters 116 whose depth of cut is limited thereby. The backup assemblies are biased outwardly toward the neutral position but are moveable to dynamically change exposure responsive to engagement forces experienced during drilling. This allows the drill bit 100 to change how aggressively the drill bit 100 drills depending on the loading conditions the drill bit 100 experiences. Several example configurations are discussed below and conceptually illustrated in subsequent figures that enable this dynamic exposure position.

The locations of the backup assemblies 50 may be strategically selected based on the drill bit design and/or expected drilling conditions. The amount of exposure and the degree of biasing may also be strategically selected. For example, a bit to be used in directional drilling may incorporate backup assemblies in the nose or shoulder region where lateral forces may be encountered. Conversely, a bit used primarily in axial drilling may rely more on backup assemblies in the nose, cone, or upper shoulder regions. As another example, a softer formation may lead to a greater depth of cut than a harder formation for a given loading, so the amount of overexposure may be increased to make the bit less aggressive for softer formations. The biasing force may also be selected based on the loading conditions.

Figure 3:
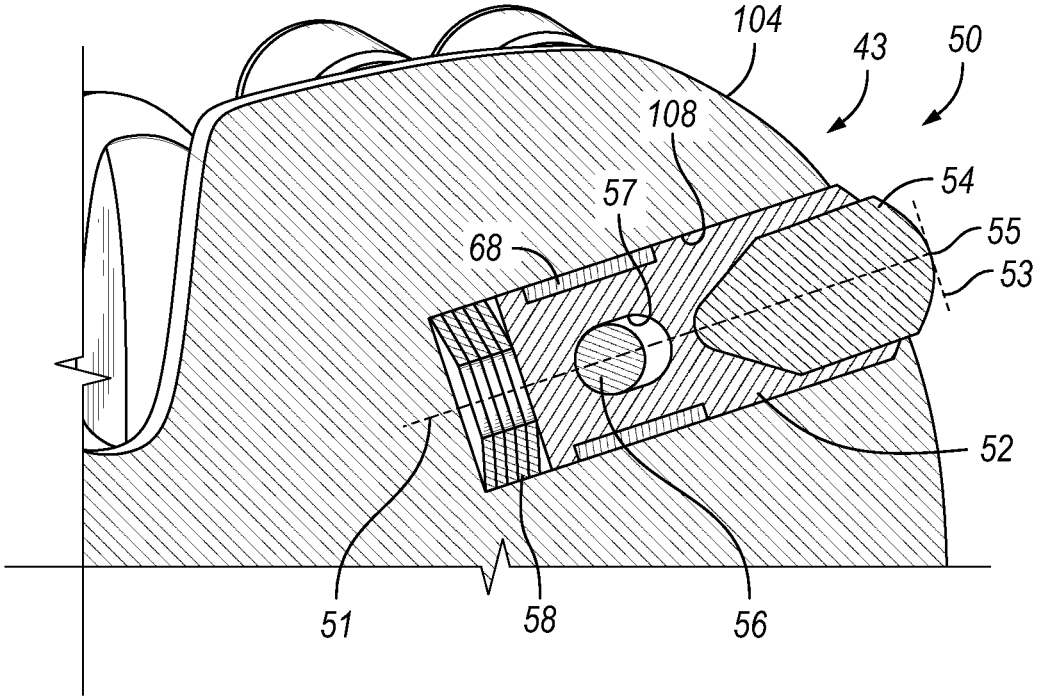
FIG. 3 is a sectional side view of a blade having a backup assembly.

FIG. 3 is a sectional side view of a blade 104 having a backup assembly 50 (e.g., the backup assembly 50*c* in the upper shoulder region 43 of FIG. 2). The backup assembly 50 includes a piston bore 108 defined in the bit body (specifically, in the blade 104 of the bit body in this example). A piston 52 is reciprocally disposed in the piston bore 108 and can move axially along a central axis 51. A backup element 54 is secured to an outwardly facing end of the piston to engage the formation and thereby limit a depth of cut of one or more cutters, particularly cutters in proximity to the backup assembly 50. In this example, the backup element 54 comprises a sacrificial, wear-resistant material rigidly coupled to the piston 52 and may be referred to more specifically as the wear element 54, although a backup element may alternatively comprise a rolling element.

In any given embodiment, the piston of a backup assembly may be retained in the piston bore with any suitable retainer allowing the piston to move inward against the biasing action of a biasing member. The piston 52 in this example is retained in the piston bore 108 with a pin 56 extending through a lateral through hole 57 formed in the piston 52 and extending into the bit body. A biasing member 58 in this example comprises a spring to bias the piston 52 outwardly to a neutral position 53. An optional dampening member 68 may be included somewhere between the piston 52 and the piston bore 108. The dampening member 68 may generally comprise a hardened elastomer and is embodied by way of example as a hardened elastomer sleeve in this example. However, any other damper could be included at any location between the piston 52 and piston bore 108, including a location in line with the spring 58. The neutral position 53 may be defined by or referenced to an outermost point 55 of the wear element 54. Specific, non-limiting example configurations of a piston for a backup assembly are presented in FIGS. 4-7.

It should be noted that, for any given configuration, numerous alternative spring configurations are available beyond the specific examples shown in the drawings. Alternative spring elements may include, for example, elastomers, compression springs, shape memory alloy springs, Belleville springs, spring bellows, and combinations thereof. The overall spring constant may be tuned, in the case of a coil spring example, by selecting the stiffness of the material, the thickness of the coil, and so forth. The spring rate could also be tuned using a stack of different thickness Belleville washers that, as a composite stack, gives a variable spring rate. Instead of Belleville washers, a compression spring with varying spring rates may be used. A variable spring rate could also be provided, such that either the spring rate requires more force to displace the assembly at first and then less force after the spring has been compressed a certain stroke length, or vice versa, depending on the desired side cutting efficiency (SCE) for the application. The spring rate may also be selected based on the rock compressive strength in that application, as well as the anticipated side load, which may in turn be determined based on the type of motor used in the application. The spring rate may also take into account at-the-bit bending-on-bit data, adjusting the stiffness to get more or less engagement depending on the desired SCE for the application.

It should also be noted that, for any given configuration, numerous alternative dampers could be provided between the piston and the piston bore to dampen movement of the piston within the piston bore. For example, a dampening fluid may be disposed in the piston bore. The dampening fluid may alternatively comprise any suitable dampening fluid such as silicone oil, to absorb shock to the system and increase component reliability for longer runs. The dampening fluid may be a non-Newtonian fluid with higher resistance to shear stress as higher or sudden impacts, and lower resistance to shear stress at lower or constant shear stress. The dampener could alternatively make use of a ferrofluid, activated by an electromagnet. The electromagnet (or a series of electromagnets) may be placed towards the front of the bore, so that as the piston pushes the ferrofluid towards the back of the bore with each retraction, the electromagnet pulls the ferrofluid back towards the front of the bore to reset it for each cycle. A fluid port may be provided to allow fluid flow to accommodate reciprocation of the piston.

Figure 4:
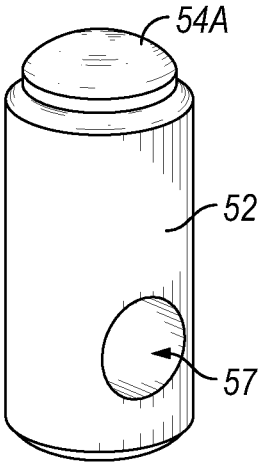
FIG. 4 is a perspective view of a piston with a dome topped backup element.

FIG. 4 is a perspective view of the piston 52 of FIG. 3, as an example configuration. The piston 52 is optionally cylindrical as shown, which may conform closely with a circular piston bore (FIG. 3). Like cutting elements used in cutters, the wear element 54 may comprise an ultra-hard, wear-resistant material, such as polycrystalline diamond (PCD), polycrystalline cubic boron nitride, impregnated diamond, etc. The wear element 54 in this example is a passive (non-cutting) wear element that lacks a cutting edge or other feature to pre-fracture rock. Rather, the wear element 54 is a smooth, dome-topped wear element with a rounded surface to facilitate sliding, frictional contact with a formation during drilling. Thus, any removal of formation material is expected to be minimal, such as incidental wearing of formation material by sliding the smooth, domed-topped wear element 54 against it. The through hole 57 is formed laterally through the cylindrical body of the piston 52 to receive a pin for securing the piston 52 to the bit body.

Figure 5:
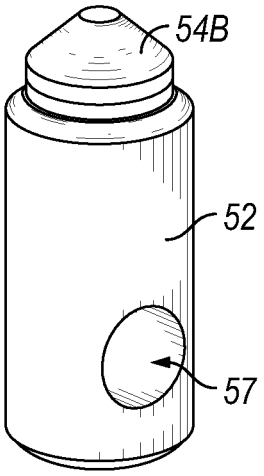
FIG. 5 is a perspective view of a piston with an active, tapered backup element.

FIG. 5 is a perspective view of another example configuration of the piston 52 of FIG. 3. The piston 52 may have the same general configuration as in FIG. 4, such as a cylindrical shape and a through hole 57 to receive a pin for securing the piston 52 to the bit body. The wear element 54B may comprise the same kinds of materials as other wear elements and as used in the cutters, such as polycrystalline diamond (PCD), polycrystalline cubic boron nitride, impregnated diamond, etc. The wear element 54B in this example is instead formed as an active, tapered diamond backup element, which has a shape used to pre-fracture rock to increase drilling efficiency.

Figure 6:
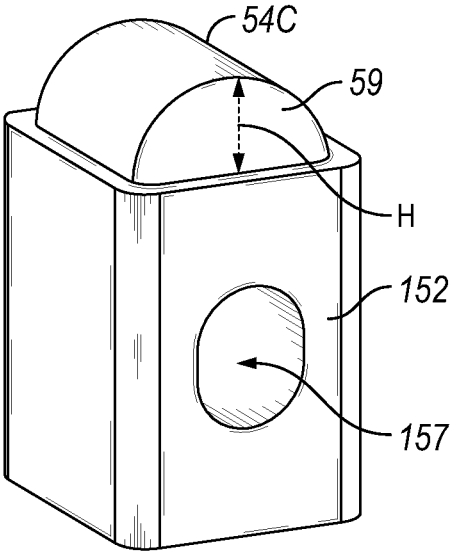
FIG. 6 is a perspective view of a piston wherein the backup element comprises a cutter rigidly secured to the piston.

FIG. 6 is a perspective view of another example configuration wherein the backup element comprises a cutter 54C rigidly secured to a piston 152. The piston 152 may have the same general configuration as in FIG. 7 (discussed below), such as a rectangular cross-sectional shape and a through hole 157 to receive a pin for securing the piston 152 to the bit body. The cutting element 54C may have the same or a similar construction as the fixed cutters on the blades (discussed above) and comprise the same kinds of materials as other wear elements and as used in fixed cutters, such as polycrystalline diamond (PCD), polycrystalline cubic boron nitride, impregnated diamond, etc. The cutting element 54C is similar in shape to the circular cutting table on some PCD cutters, including a cutting edge 59. The cutting element 54C is oriented at a cutting orientation with respect to the formation, by virtue of the mounting of the piston to the bit body and the mounting of the cutting element 54C to the piston so the cutting edge 59 may engage the formation behind a primary cutter.

The cutting element 54C is recessed into an end of the piston 152 to position just a portion of the cutting element 54C at a height "H" above the end of the piston 152. The value of H may be selected according to a particular design and is not limited to the example of FIG. 6. In some configurations, the height H may be selected to limit a depth of cut of the cutting element 54C. For example, the cutting element 54C may be configured as a backup cutter to one of the primary fixed cutters secured directly to a blade, in which case it may be desirable to limit how much the cutting element 54C, as a backup element, engages with the formation as compared with how much a primary cutter is allowed to engage the formation. With sufficient engagement force from the formation, therefore, a primary cutter may have a larger depth of cut than the cutting element 54C used as a backup element.

Figure 7:
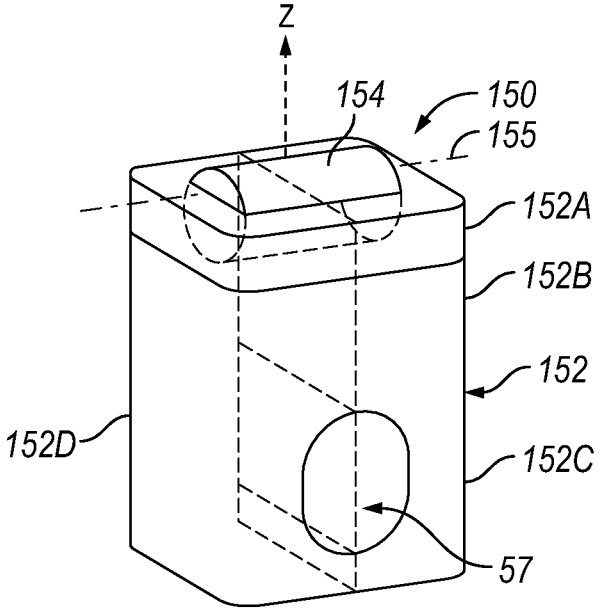
FIG. 7 is a perspective view of a piston wherein the backup element comprises a rolling element rotatably secured to the piston.

FIG. 7 is a perspective view of a backup assembly 150 wherein the wear element is a rolling element 154 rotatably secured to a piston 152 about a rolling element axis 155 transverse to an axial direction "Z" of the piston 152. The piston 152 optionally comprises a multi-piece housing with opposing members joined about the rolling element 154 to rotatably secure the rolling element 154. More specifically, in this example, the piston 152 comprises an upper housing portion 152A and a lower housing portion 152B that are joined about the rolling element 154. In an alternative configuration, as indicated in dashed line type, two opposing housing members 152C, 152D may be joined at opposing axial ends of the rolling element 154. The housing members 152A, 152B (or 152C, 152D) may be joined by any suitable method, such as welding, brazing, snap-together features like pins or barbed connectors, for example. The piston 152 in this example optionally comprises a generally rectangular cross-section which helps to provide sufficient material about the rolling element, which happens to have a rectangular cross section in a plane aligned through the rolling element axis 155. Like the previous piston configurations, the piston 152 includes the through hole 57 to receive a pin for securing the piston 152 to the bit body.

In this embodiment, the rolling element 154 may be oriented to roll flat against the formation. In another embodiment, the orientation of the rolling element may be angled to position an edge of the rolling element to operate as a cutter, or a hybrid of a rolling depth of cut control (DOCC) element and a cutter.

Figure 8:
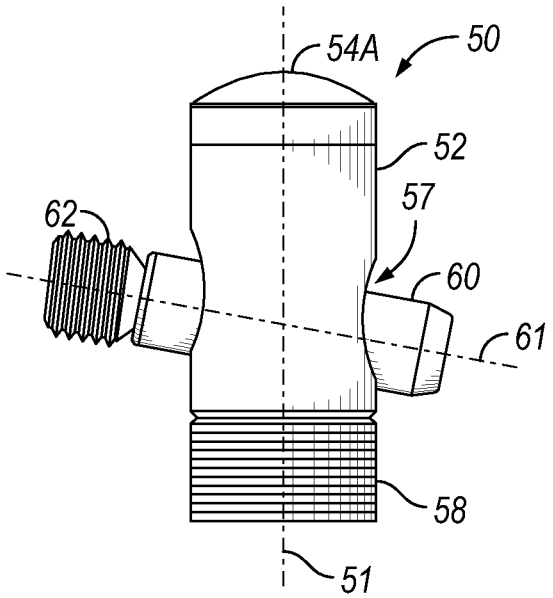
FIG. 8 is a side view of a backup assembly of FIG. 4 with a pin to secure it to the bit body.

FIG. 8 is a side view of the backup assembly 50 of FIG. 4 with an example of a pin 60 that may be used to secure the piston 52 to the bit body. The piston 52 has a central axis 51 and may be mounted on the bit body to reciprocate (move axially) in an axial direction aligned with the central axis 51. The spring 58 biases the piston 52 (with wear element 54A) outwardly and may be urged inwardly against the biasing action of the spring 58. The pin 60 includes a threaded end 62 that may be used to secure the piston 152 to the bit body. The pin 60 also has an axis 61 that is transverse to the central axis 51 of the piston 52. The through hole 57 may be wider than the pin in the direction of piston travel to allow relative movement of the piston 52 with respect to the pin 60 while still being retained by the pin 60.

Figure 9:
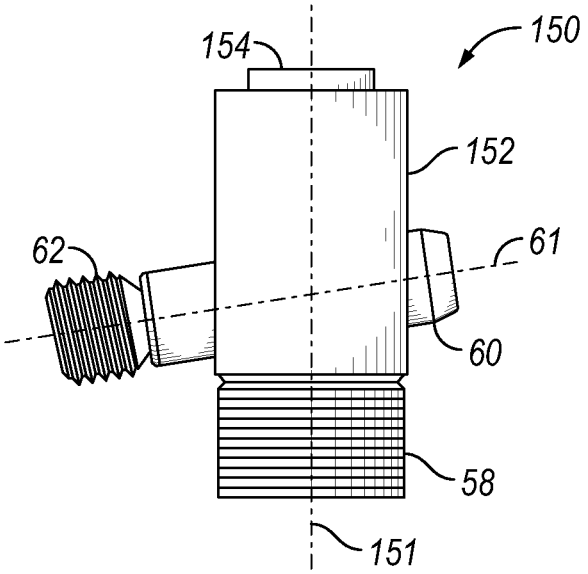
FIG. 9 is a side view of a backup assembly of FIG. 7 with the pin to secure it to the bit body.

FIG. 9 is a side view of the backup assembly 150 of FIG. 7 with the pin 60 that may be used to secure the piston 152 to the bit body. The piston 152 has a central axis 151 and may be mounted on the bit body to reciprocate (move axially) in an axial direction aligned with the central axis 151. The spring 58 biases the piston 152 (with rolling element 154) outwardly and may be urged inwardly against the biasing action of the spring 58. The pin 60 may be similar to its configuration in FIG. 8 including the threaded end 62 that may be used to secure the piston 152 to the bit body. The axis 61 is also transverse to the central axis 151 of the piston 152, except in this case the pin 60 is angled upwardly relative to its downward angle in FIG. 8. This merely illustrates that alternate transverse positionings are possible, including perpendicular, and the angle selected could facilitate manufacturing or assembly depending on the bit and blade configuration. The backup assembly 150 in this configuration allows simultaneous rolling of the rolling element 154 against the formation and axial reciprocation along the piston axis 151 responsive to loading by the formation.

Although the pins in FIGS. 8 and 9 are threaded, any suitable method and structure may be used for securing a pin to the bit body. For example, a pin may be press-fit into a corresponding pin hole on the bit body, e.g., where an OD of the pin is slightly larger than the pin hole. In other embodiments, snap rings may be used to secure the pins. Other examples include adhesives, e.g., epoxy. A pin may also be welded or brazed to secure the pin to the bit body.

The foregoing backup assemblies and the various features and components thereof are provided by way of example. Different shapes of wear elements and pistons, different material combinations, different mounting orientations, different biasing members, and so forth may be constructed according to this disclosure. These and other features may be combined in any suitable combination to construct one or more backup assemblies that are reciprocally mounted to a bit body and include a fixed or rolling backup element for engaging the formation to dynamically limit engagement of cutters with the formation. Any of the backup assemblies may be secured to the bit body with a selected exposure relative to the cutting profile collectively defined by cutters. For example, each backup assembly may be biased to a neutral position that is aligned with or over-exposed relative to the cutter profile.

Figure 10:
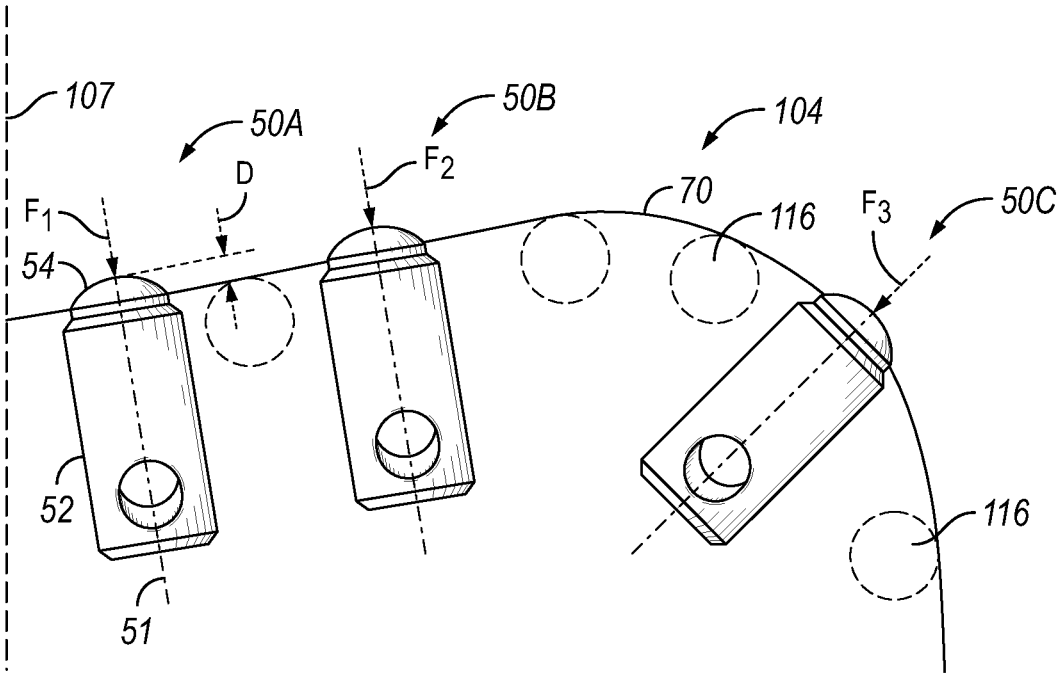
FIG. 10 is a schematic profile of a blade wherein backup assemblies are over-exposed relative to a cutter profile.

FIG. 10 is a schematic profile of a blade 104 wherein backup assemblies 50 individually designated at 50A, 50B, 50C are over-exposed relative to a cutter profile 70. The first backup assembly 50A may be in the cone region; the second backup assembly may be in the nose region; and the third backup assembly 50C may be in the shoulder region of the bit body. The cutter profile 70 is defined by a plurality of cutters 116. The over-exposed positions of the backup assemblies 50 may be a neutral position of the backup assemblies 50 when not drilling or otherwise applying force to the backup elements 54. The backup assemblies 50 are axially moveable along their respective axes 51 inwardly of the neutral position. A biasing member (discussed infra) may bias the backup assemblies 50 to this neutral position. The cutters 116 are schematically drawn and are not intended to be limiting in terms of cutter placement on the blade 104. Generally, the backup assemblies 50 are positioned to limit engagement of cutters 116 for which the backup assemblies are within or overlapping a sweep path of the respective cutters about the bit axis 107, or otherwise in proximity with the backup assemblies.

The backup assemblies 50 in FIG. 10 are overexposed, in that they extend outwardly of the cutter profile 70. The exposure may be measured as a depth "D" in an axial direction of the piston 52. If the backup assemblies are biased to this overexposed position, the wear elements 54 of the backup assemblies 50 will tend to make initial contact with the formation prior to the cutters 116 contacting the formation. As an engagement force "F" with the formation at each backup assembly 50 increases, the pistons 52 and included wear elements 54 may be urged inwardly in relation to the magnitude of the engagement forces. Thus, as the engagement force increases, the backup assemblies 50 will be urged inwardly until the cutters 116 contact and begin cutting the formation. As the engagement forces increase further, the backup assemblies 50 will be urged further inwardly, further reducing their exposure and increasing the depth of cut of the cutters 116.

The engagement forces at the first, second, and third backup assemblies 50A-C are individually indicated as F1, F2, and F3. These forces may vary with respect to each other. As a result, the backup assemblies may move independently of each other, and their individual exposures may independently vary. For example, during an axial loading of the drill bit (along a direction of the bit axis 107) the cone and nose regions may experience greater engagement forces F1 and F2 than the engagement force F3 in the shoulder region. By comparison, the loading in the shoulder region may be greater when drilling curved sections, causing F3 to increase and the exposure of the third backup assembly 50C to correspondingly increase. Thus, the backup assemblies individually dynamically adjust their exposure in response to a myriad of different loading conditions that may be experienced while drilling.

Figure 11:
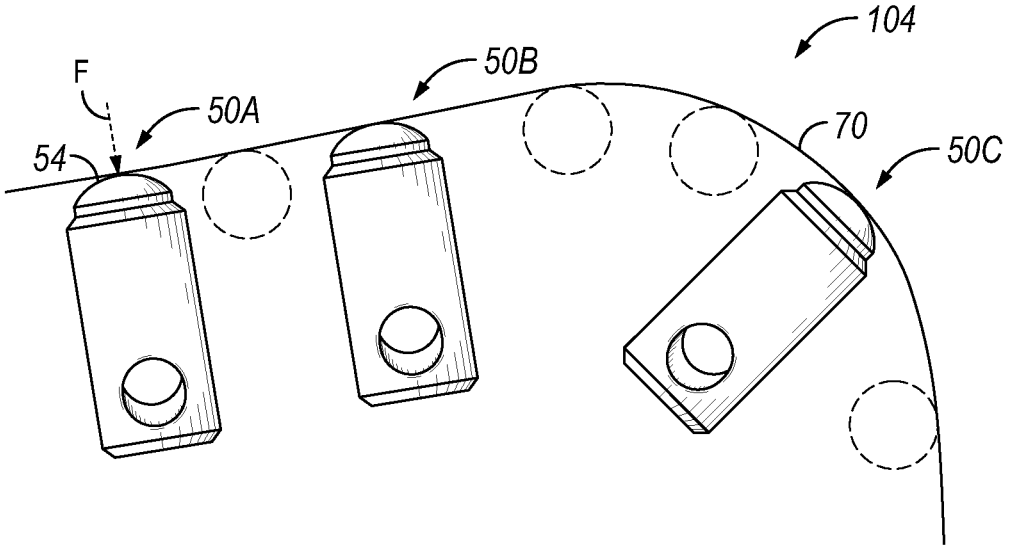
FIG. 11 is another profile of the blade wherein the backup assemblies are aligned with the cutting profile.

FIG. 11 is another profile of the blade 104 wherein the backup assemblies 50A, 50B, 50C are instead aligned with the cutting profile 70. This may represent the positions of the backup assemblies after they have been urged inwardly from positions of FIG. 10 in response to a certain magnitude of engagement force. Alternatively, this may represent the positions of the backup assemblies in another configuration wherein the neutral positions are aligned with the cutting profile (i.e., a zero-exposure neutral position). Being aligned with the cutting profile in this context is associated with substantially zero exposure relative to the cutting profile 70, versus being over-exposed (FIG. 10) or under-exposed. In the case of a zero-exposure neutral position, the cutters 116 and wear element 54 will engage the formation at about the same time. As the engagement force F increases, the backup assemblies 50 will be urged inwardly to increase the depth of cut of the cutters 116.

The foregoing examples provide just one range of examples of different piston retainers comprising a pin to moveably and through hole on the piston to retain the pistons in their respective cavities. However, in any given embodiment, the piston of a backup assembly may be retained in the piston bore with any suitable retainer allowing the piston to move inward against the biasing action of a biasing member. In a first alternative example, a ball race may be defined between the piston and piston bore. Ball bearings may be fed into the piston race (e.g., through an access opening) to prevent removal of the piston from the piston bore, but with sufficient axial play to allow some axial movement of the piston within the piston bore. In a second alternative example, the piston may be held within the piston bore with a retaining ring. A third alternative example may comprise a piston retainer using barbed fittings extending from the inner-most (back surface) of the piston bore. Other features and methods for retaining the piston within the piston bore are also considered within the scope of this disclosure.

The above apparatus examples and other apparatus with different combinations of the disclosed features may be used in a drilling method. The method may comprise rotating a drill bit about a rotational axis while engaging a formation to be drilled. The drill bit includes one or more cutters secured to a bit body, such as to a cone region, a nose region, a shoulder region, and/or a gage region of the bit body. The cutters collectively define a cutting profile about the rotational axis of the bit.

According to the method, a depth of cut of one or more of the cutters may be limited by engaging the formation with a wear element. The wear element is supported on a piston moveably coupled to the bit body, such as at least at the cone region, nose region, or shoulder region. The piston and wear element may be biased outwardly toward a neutral position, while allowing the piston to reciprocate inward from the neutral position in relation to a force of engagement with the formation. The neutral position may be aligned with the cutting profile in one or more embodiments. In other embodiments, the neutral position may be over-exposed relative to the cutter profile.

In some examples, the wear element may be rigidly coupled to the piston and slide along the formation while drilling to support the drill bit. In other examples, the wear element may comprise a rolling element rotatably supported on the piston about a rolling element axis transverse to an axial direction of the piston. The rolling element may roll about the rolling element axis while drilling, in combination with the piston reciprocating in response to an engagement force with the formation. The method may comprise moveably retaining the piston in the piston bore with a fastener extending transversely through a retention hole on the piston and into the bit body. The retention hole in the piston may be wider than the fastener in an axial direction of the piston to allow reciprocation of the piston within the piston bore.

Accordingly, a drill bit and method are disclosed that incorporate backup assemblies to limit depth of engagement of cutters with the formation, and which dynamically adjust exposure in response to downhole loading conditions. The methods/systems/compositions/tools may include any of the various features disclosed herein, including one or more of the following statements.

Statement 1. A drill bit, comprising: a bit body defining a rotational axis and including a cone region, a nose region, a shoulder region, and a gauge region; one or more cutters secured to at least one of the cone, nose, shoulder, and gage regions of the bit body; and a backup assembly on the cone, nose, or shoulder region, the backup assembly comprising a piston bore defined in the bit body, a piston reciprocally disposed in the piston bore, a backup element on the piston for contact with the formation, a piston retainer for moveably retaining the piston in the piston bore, and a biasing member configured for biasing the piston outwardly to a neutral position to limit a depth of cut of one or more of the cutters.

Statement 2. The drill bit of Statement 1, wherein the neutral position of the backup element is aligned with or over-exposed relative to a cutter profile defined by the one or more of the cutters.

Statement 3. The drill bit of Statement 1 or 2, wherein the piston retainer comprises: a retention hole defined transversely through the piston; and a fastener extending through the retention hole and into the bit body to retain the piston within the piston bore.

Statement 4. The drill bit of Statement 3, wherein the retention hole in the piston is wider than the fastener in an axial direction of the piston to allow reciprocation of the piston within the piston bore.

Statement 5. The drill bit of any of Statements 1 to 4, wherein the backup element is rigidly attached to the piston.

Statement 6. The drill bit of any of Statements 1 to 5, wherein the backup element rigidly attached to the piston comprises a dome-topped wear element, impact arrestor, modified diamond round, or a cutter.

Statement 7. The drill bit of any of Statements 1 to 6, wherein the backup element comprises a rolling element rotatably secured to the piston about a rolling element axis transverse to an axial direction of the piston.

Statement 8. The drill bit of any of Statements 1 to 7, wherein the piston comprises a multi-piece housing with housing members joined about the rolling element to rotatably secure the rolling element between the opposing housing members.

Statement 9. The drill bit of any of Statements 1 to 8, further comprising: a dampener between the piston and the bit body to dampen a reciprocation of the piston within the piston bore.

Statement 10. The drill bit of Statement 8, wherein the damper comprises a hard elastomer.

Statement 11. A drill bit, comprising: a bit body defining a rotational axis and including a cone region, a nose region, a shoulder region, and a gauge region; one or more primary cutters secured to at least one of the cone, nose, shoulder, and gage regions of the bit body; and a reciprocating backup assembly on the bit body, the backup assembly comprising a piston bore defined in the bit body, a piston reciprocally disposed in the piston bore, a biasing member biasing the piston outwardly to a neutral position, and an active backup element on an outwardly facing end of the piston to cut rock ahead of one or more of the primary cutters.

Statement 12. The drill bit of Statement 11, wherein the piston comprises a multi-piece housing with opposing members joined about the rolling element to rotatably secure the rolling element to the opposing members of the housing.

Statement 13. The drill bit of Statement 11 or 12, wherein the neutral position of the backup element is aligned with or over-exposed relative to a cutter profile defined by one or more of the cutters.

Statement 14. The drill bit of any of Statements 11 to 13, wherein the piston retainer comprises: a retention hole defined transversely through the piston; and a fastener extending through the retention hole and into the bit body to retain the piston within the piston bore.

Statement 15. The drill bit of Statement 14, wherein the retention hole in the piston is wider than the fastener in an axial direction of the piston to allow reciprocation of the piston within the piston bore.

Statement 16. A method, comprising: rotating a drill bit about a rotational axis while engaging a formation, the drill bit including one or more cutters secured to the bit body, the cutters collectively defining a cutting profile about the rotational axis; limiting a depth of cut of one or more of the cutters by engaging the formation with a backup element supported on a piston moveably coupled to the bit body at the cone region, nose region, or shoulder region; and biasing the backup element outwardly toward a neutral position while allowing the piston to reciprocate inward from the neutral position in relation to a force of engagement with the formation.

Statement 17. The method of Statement 16, wherein the neutral position is aligned with or over-exposed relative to the cutter profile.

Statement 18. The method of Statement 16 or 17, further comprising: rotatably supporting the backup element on the piston about a rolling element axis transverse to an axial direction of the piston; and allowing the backup element to roll about the rolling element axis while allowing the piston to reciprocate.

Statement 19. The method of any of Statements 16 to 18, further comprising: moveably retaining the piston in the piston bore with a fastener extending transversely through a retention hole on the piston and into the bit body, wherein the retention hole in the piston is wider than the fastener in an axial direction of the piston to allow reciprocation of the piston within the piston bore.

Statement 20. The method of any of Statements 16 to 19, further comprising engaging the backup element with the formation to disintegrate formation material ahead of the one or more cutters.

To facilitate a better understanding of the present invention, the following examples of certain aspects of some embodiments are given. In no way should the following examples be read to limit, or define, the entire scope of the disclosure.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A drill bit, comprising:

a bit body defining a rotational axis and including a cone region, a nose region, a shoulder region, and a gauge region;

one or more cutters secured to at least one of the cone, nose, shoulder, or gage regions of the bit body; and a backup assembly on the cone, nose, or shoulder region, the backup assembly comprising a piston bore defined in the bit body, a piston reciprocally disposed in the piston bore, a backup element on the piston for contact with the formation, a piston retainer for moveably retaining the piston in the piston bore, and a biasing member configured for biasing the piston outwardly to a neutral position to limit a depth of cut of one or more of the cutters, wherein the piston retainer comprises a retention hole defined transversely through the piston and a fastener extending through the retention hole and into the bit body to retain the piston within the piston bore, wherein the retention hole in the piston is wider than the fastener in an axial direction of the piston to allow reciprocation of the piston within the piston bore.

2. The drill bit of claim 1, wherein the neutral position of the backup element is aligned with or over-exposed relative to a cutter profile defined by the one or more of the cutters.

3. The drill bit of claim 1, wherein the backup element is rigidly attached to the piston.

4. The drill bit of claim 3, wherein the backup element rigidly attached to the piston comprises a dome-topped wear element, impact arrestor, modified diamond round, or a cutter.

5. The drill bit of claim 1, wherein the backup element comprises a rolling element rotatably secured to the piston about a rolling element axis transverse to an axial direction of the piston.

6. The drill bit of claim 5, wherein the piston comprises a multi-piece housing with housing members joined about the rolling element to rotatably secure the rolling element between the opposing housing members.

7. The drill bit of claim 1, further comprising:

a dampener between the piston and the bit body to dampen a reciprocation of the piston within the piston bore.

8. The drill bit of claim 7, wherein the dampener comprises a hard elastomer.

9. A drill bit, comprising:

a bit body defining a rotational axis and including a cone region, a nose region, a shoulder region, and a gauge region;

one or more primary cutters secured to at least one of the cone, nose, shoulder, or gage regions of the bit body; and a reciprocating backup assembly on the bit body, the backup assembly comprising a piston bore defined in the bit body, a piston reciprocally disposed in the piston bore, a biasing member biasing the piston outwardly to a neutral position, an active backup element on an outwardly facing end of the piston to cut rock ahead of the one or more primary cutters, and a piston retainer comprises a retention hole defined transversely through the piston and a fastener extending through the retention hole and into the bit body to retain the piston within the piston bore, wherein the retention hole in the piston is wider than the fastener in an axial direction of the piston to allow reciprocation of the piston within the piston bore.

10. The drill bit of claim 9, wherein the piston comprises a multi-piece housing with opposing members joined about a rolling element to rotatably secure the rolling element, wherein two opposing members are joined at opposing axial ends of the rolling element.

11. The drill bit of claim 9, wherein the neutral position of the backup element is aligned with or over-exposed relative to a cutter profile defined by one or more of the cutters.

12. A method, comprising:

rotating a drill bit about a rotational axis while engaging a formation, the drill bit including one or more cutters secured to the bit body, the cutters collectively defining a cutting profile about the rotational axis;

limiting a depth of cut of one or more of the cutters by engaging the formation with a backup element supported on a piston moveably coupled to the bit body at the cone region, nose region, or shoulder region;

biasing the backup element outwardly toward a neutral position while allowing the piston to reciprocate inward from the neutral position in relation to a force of engagement with the formation;

rotatably supporting the backup element on the piston about a rolling element axis transverse to an axial direction of the piston; and allowing the backup element to roll about the rolling element axis while allowing the piston to reciprocate.

13. The method of claim 12, wherein the neutral position is aligned with or over-exposed relative to the cutter profile.

14. The method of claim 12, further comprising:

moveably retaining the piston in the piston bore with a fastener extending transversely through a retention hole on the piston and into the bit body, wherein the retention hole in the piston is wider than the fastener in an axial direction of the piston to allow reciprocation of the piston within the piston bore.

15. The method of claim 12, further comprising engaging the backup element with the formation to disintegrate formation material ahead of the one or more cutters.

* * * * *